US006427835B1

(12) United States Patent
Chang

(10) Patent No.: US 6,427,835 B1
(45) Date of Patent: Aug. 6, 2002

(54) CLUB DIVIDER OF GOLF BAG

(76) Inventor: Shu-Chin Chang, 36, Lane 64, Tzu Chih Road, Ta Tu Village, Ta Tu Hsiang, Taichung-Hsien (TW)

( * ) Notice: Subject to any disclaimer, the term of this patent is extended or adjusted under 35 U.S.C. 154(b) by 0 days.

(21) Appl. No.: 09/730,726

(22) Filed: Dec. 7, 2000

(51) Int. Cl.[7] ..... A63B 55/06
(52) U.S. Cl. ..... 206/315.6; 206/315.2
(58) Field of Search ..... 206/315.6, 315.2, 206/315.3; D3/254, 255, 259

(56) References Cited

U.S. PATENT DOCUMENTS 4,522,299 A * 6/1985 Clark et al. ..... 206/315.3
4,691,823 A * 9/1987 Page ..... 206/315.6
D407,900 S * 4/1999 Baird ..... D3/320
5,918,737 A * 7/1999 Kwon ..... 206/315.3
5,971,147 A * 10/1999 Sutter ..... 206/315.6
5,984,095 A * 11/1999 Kim ..... 206/315.6

FOREIGN PATENT DOCUMENTS

JP 3-247364 * 3/1991 ..... 206/315.6
JP 6-15020 * 6/1994 ..... 206/315.6

* cited by examiner

*Primary Examiner*—Nathan J. Newhouse
*Assistant Examiner*—Lien Ngo
(74) *Attorney, Agent, or Firm*—Rabin & Berdo, P.C.

(57) ABSTRACT

A club divider of golf bag is provided. An annular frame is provided on either top or bottom opening of the bag. Each frame has a plurality of corrugated longitudinal members formed therein. The same number of club dividers formed of fabric or flexible plate are connected between the corresponding corrugated longitudinal members of frames. This can orderly keep golf clubs in the golf bag.

2 Claims, 8 Drawing Sheets

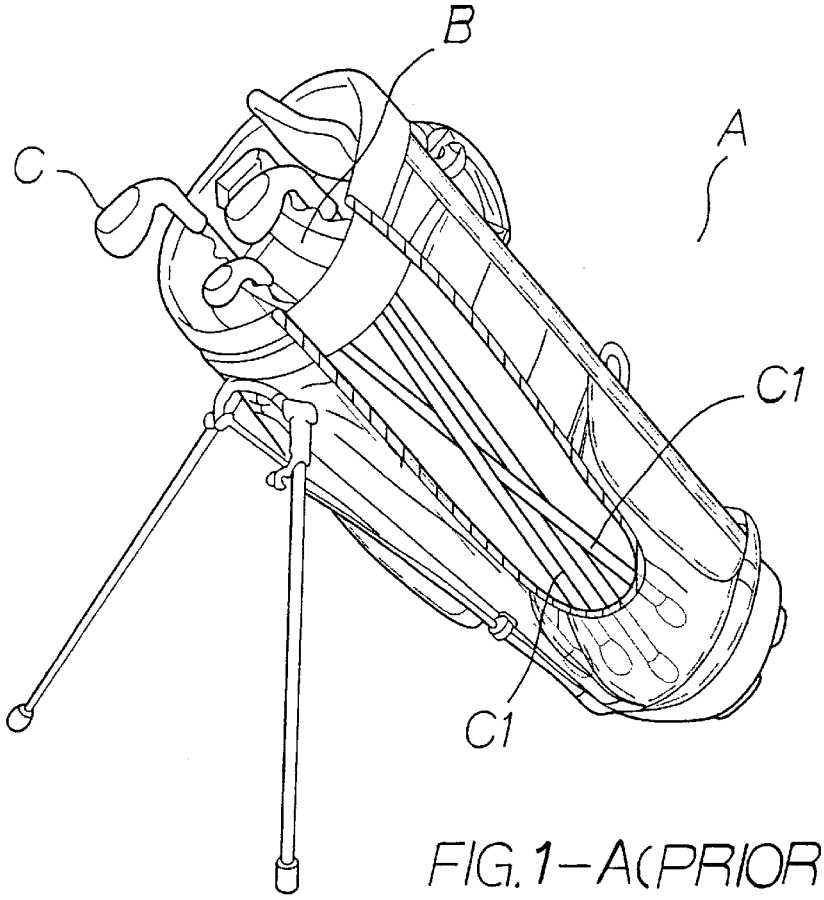
FIG. 1-A(PRIOR ART)
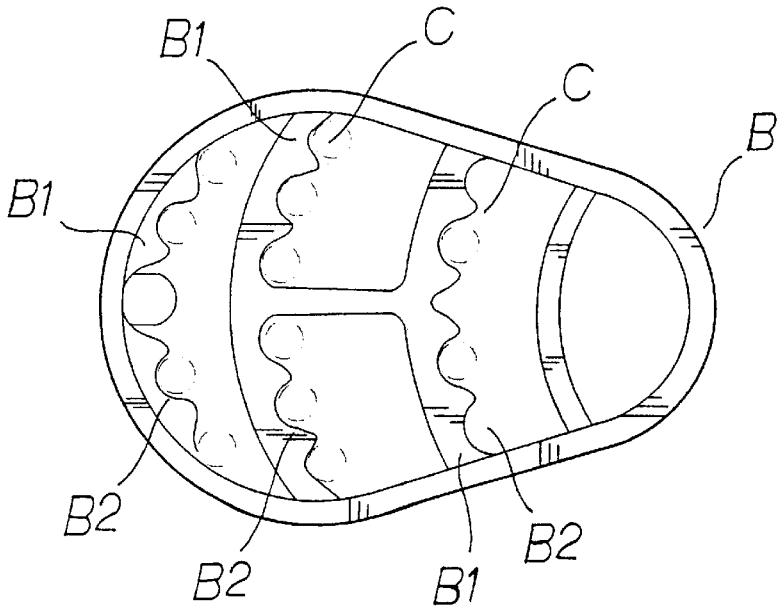
FIG. 1-B(PRIOR ART)

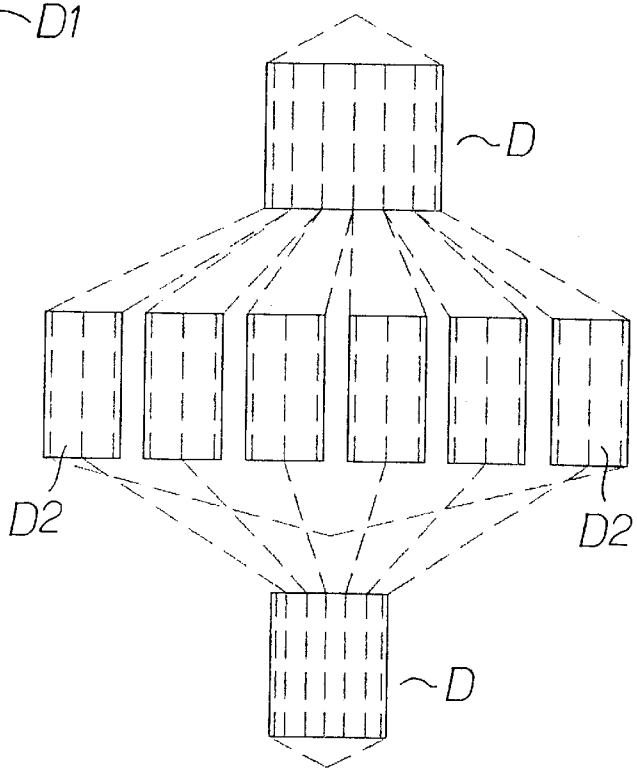
FIG. 2-C(PRIOR ART)
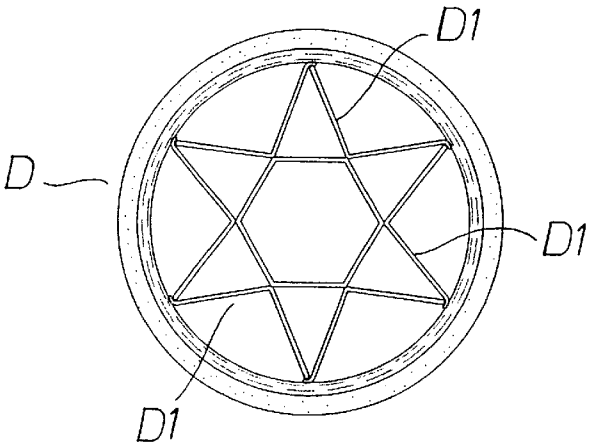
FIG. 2-B PRIOR ART
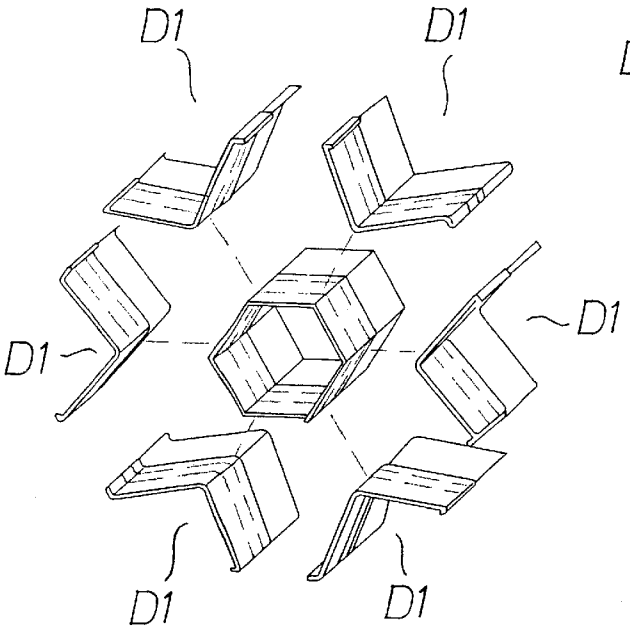
FIG. 2-A(PRIOR ART)

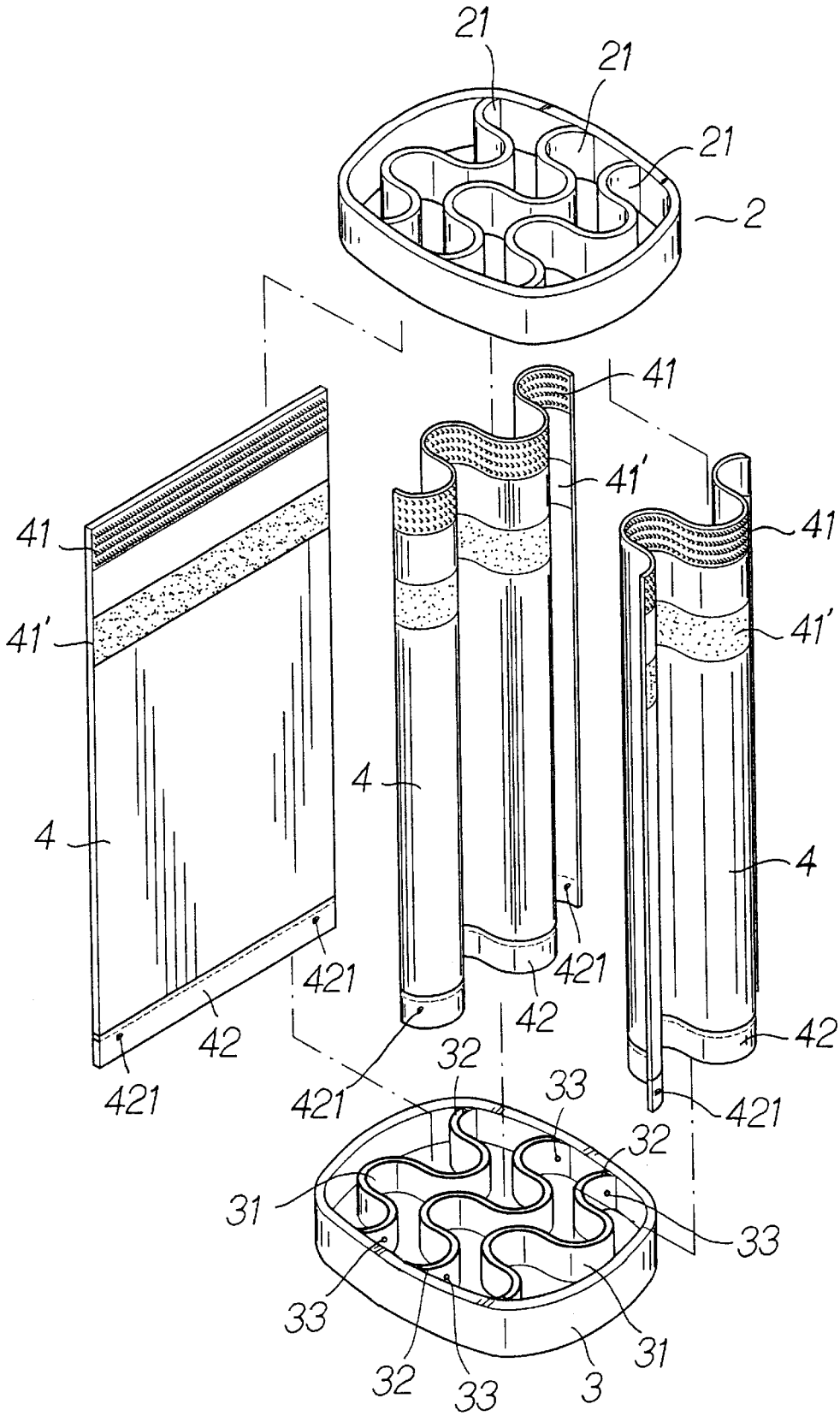
FIG. 3-A

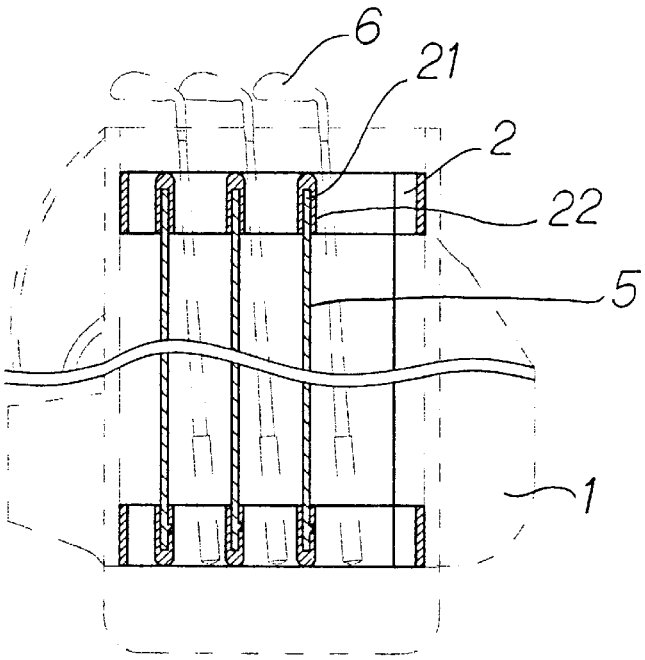
FIG. 4-B
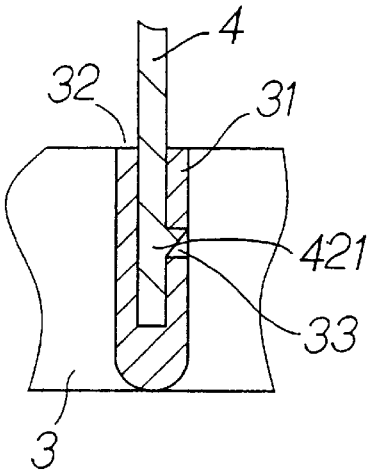
FIG. 3-C
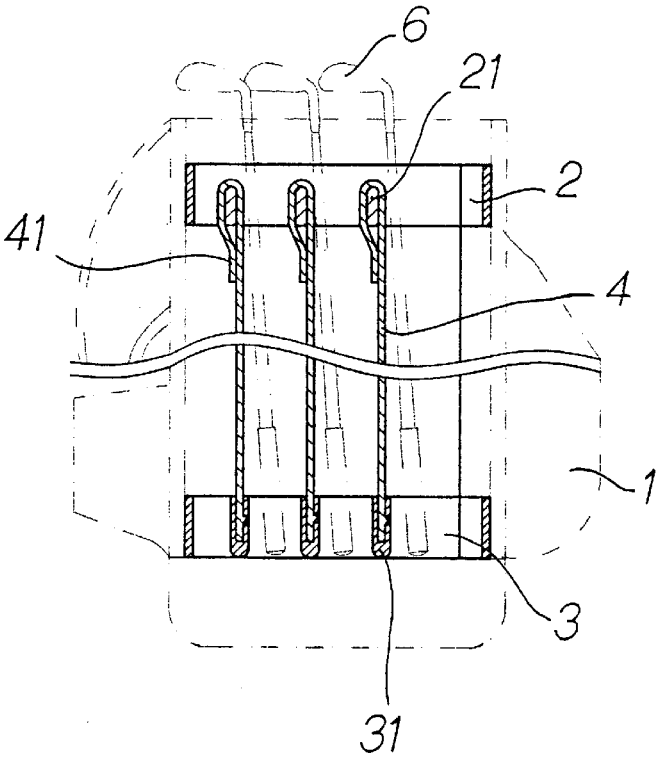
FIG. 3-B

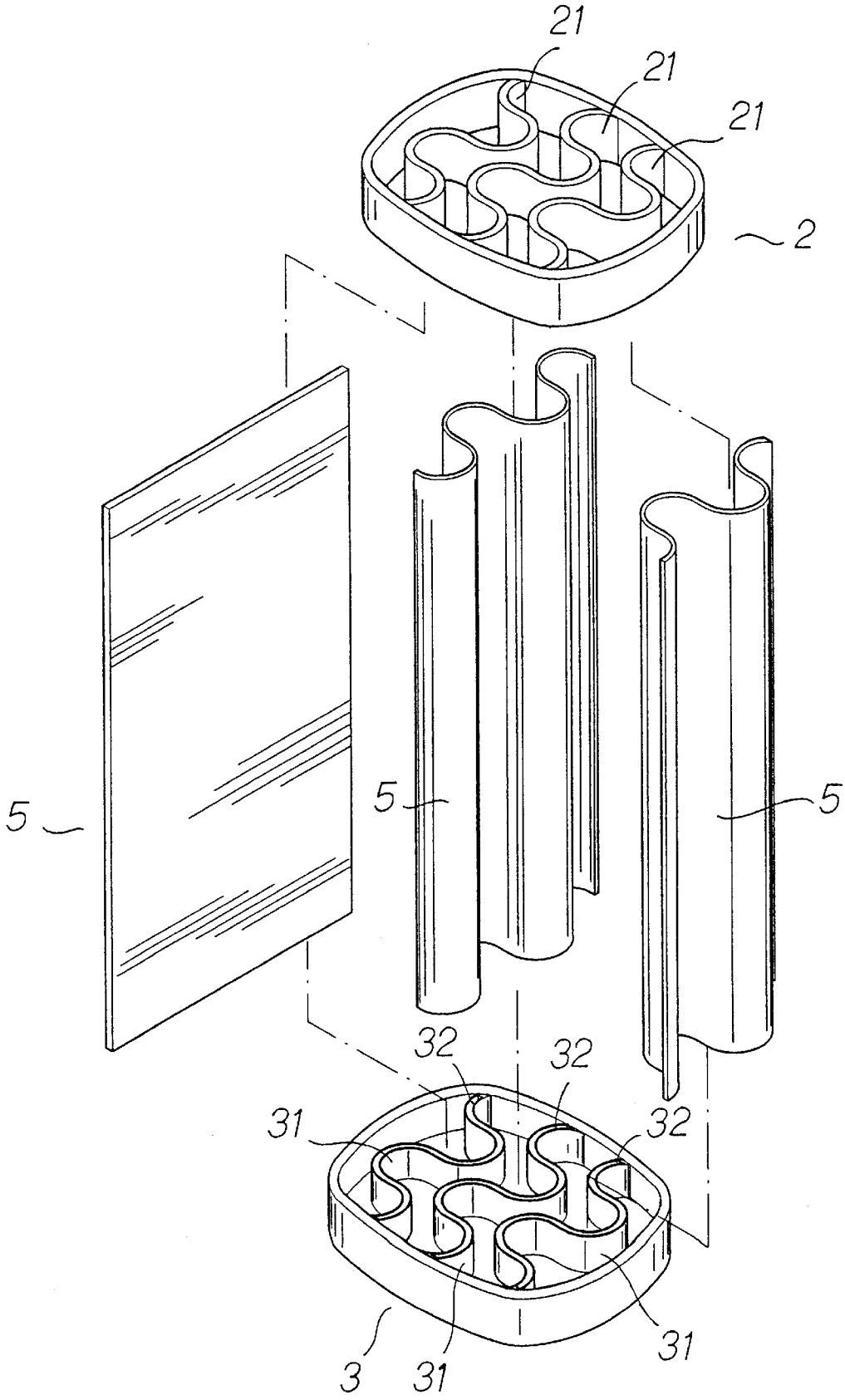
FIG. 4-A

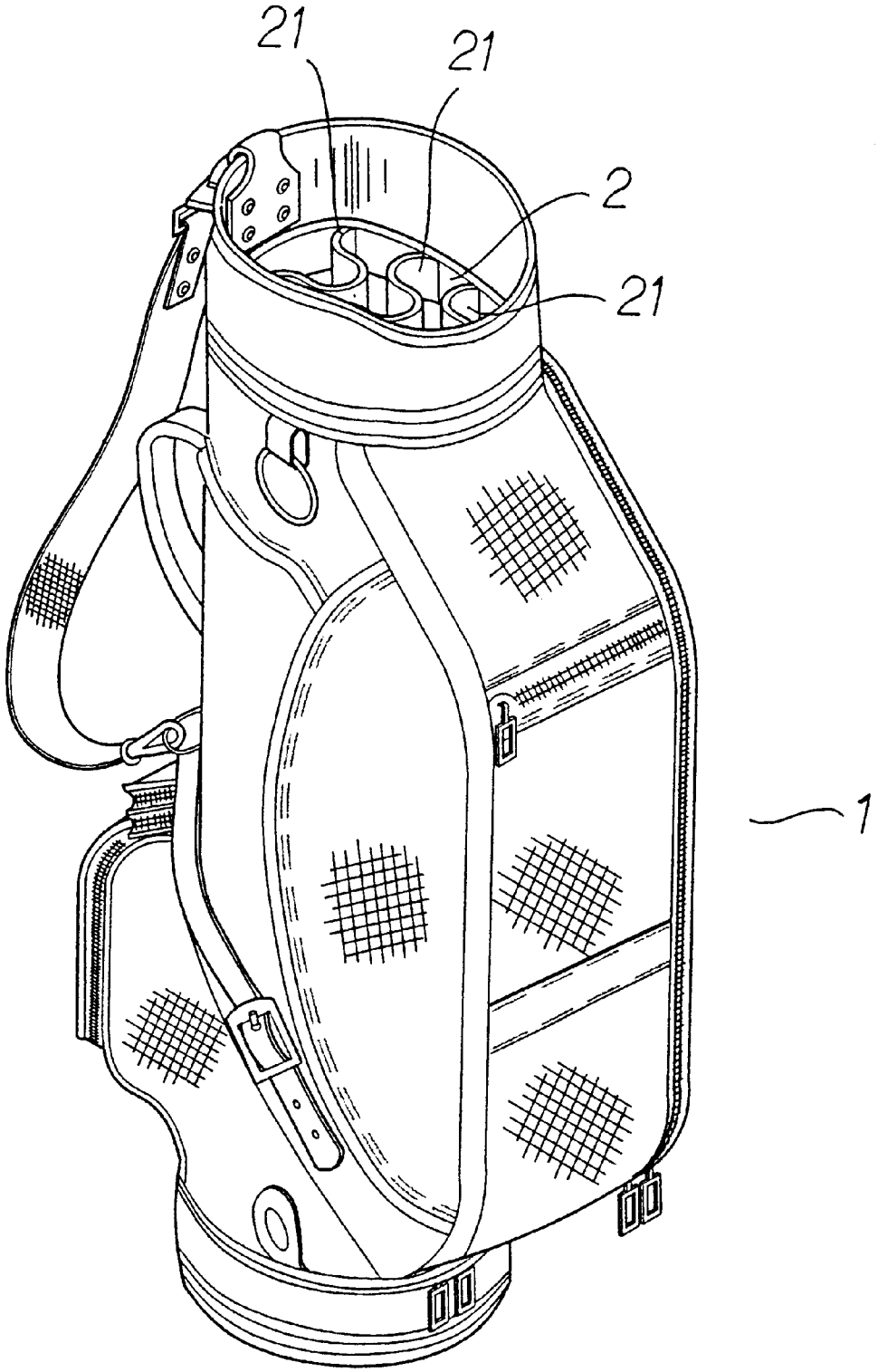
FIG. 5-A

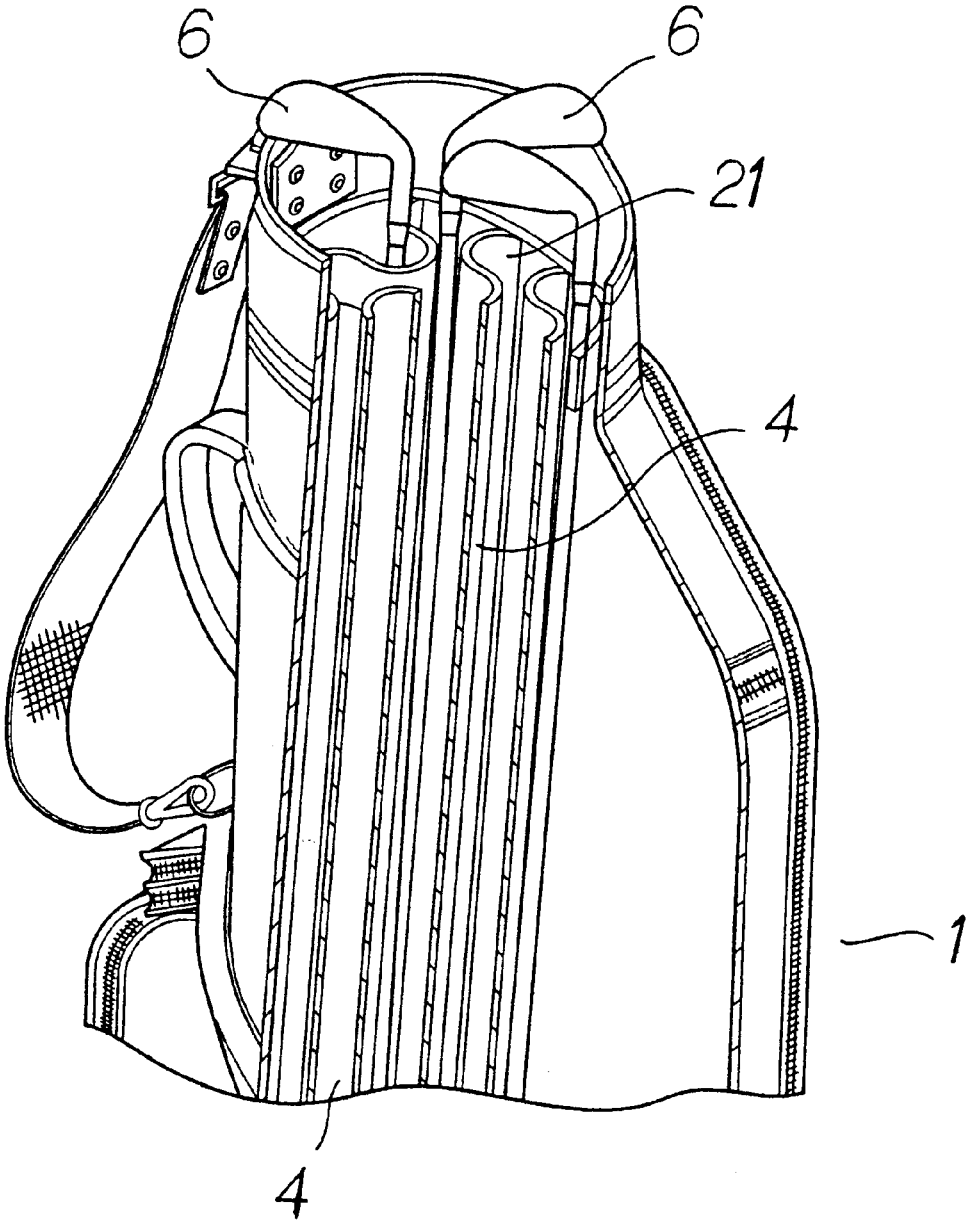
FIG. 5-B

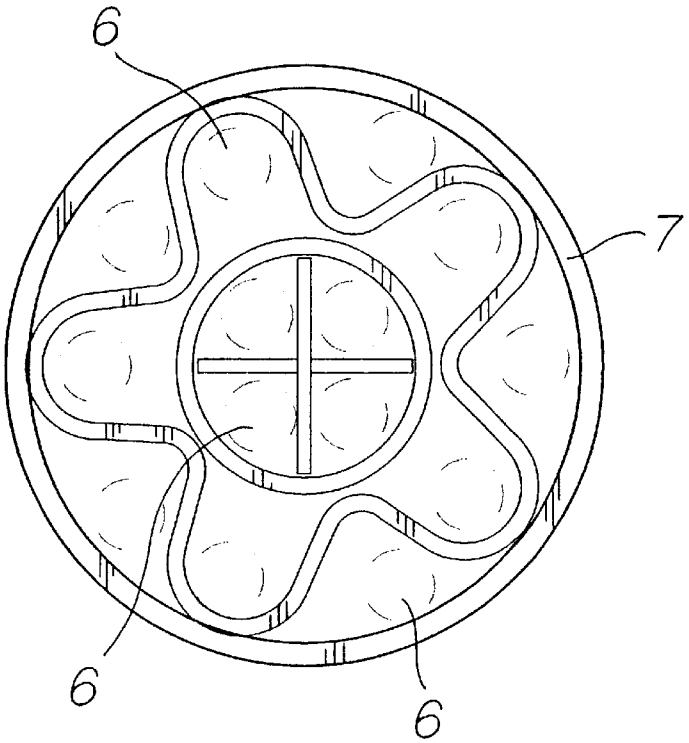
FIG. 6
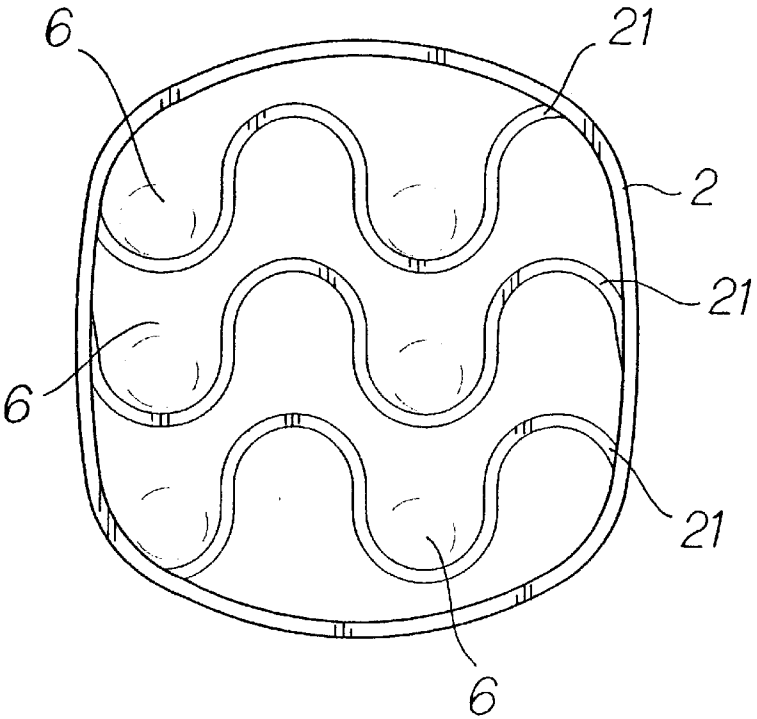
FIG. 5–C

CLUB DIVIDER OF GOLF BAG

FIELD OF THE INVENTION

The present invention relates to golf bags and more particularly to an improved club divider of golf bag for keeping golf clubs in good order.

BACKGROUND OF THE INVENTION

A conventional golf bag A is shown in FIGS. 1A and 1B wherein an annular frame B is provided on the top. A plurality of club dividers B1 are formed in frame B. A wavy surface B2 is formed on each club divider B1 for receiving golf clubs C in the valleys of wavy surface B2. However, the previous design suffered from two disadvantages. For example, it is designed that only a frame B is provided. That is, no corresponding frame B provided on the bottom of golf bag A and no divider provided between the top frame B and the bottom of golf bag A. Hence, shafts C1 of golf clubs C may be interlaid in the bag A. This may interfere the pulling of a desired golf club C. In a worse condition, user has to take all golf clubs C out of bag A before choosing the desired golf club C. This is very inconvenient. Further, the valleys of wavy surface B2 are shallow. As such, it is possible for one golf club C located in a valley to displace after the bag A is shaken. This may further cause a disorderliness of golf clubs C.

Another conventional golf bag A is shown in FIGS. 2A, 2B, and 2C wherein a frame D is provided on the top and consists of a plurality of club dividers D1. Each club divider D1 comprises a plurality of substantially rectangular plate members D2. But this is still unsatisfactory for the purpose for which the invention is concerned because it is time consuming to stitch all plate members D2 together to form a frame D. Also, the manufacturing cost is relatively high.

Thus, it is desirable to provide an improved club divider of golf bag in order to overcome the above drawbacks of prior art.

SUMMARY OF THE INVENTION

It is thus an object of the present invention to provide a golf bag wherein an annular frame is provided on either top or bottom opening of the bag. Each frame has a plurality of corrugated longitudinal members formed therein. The same number of club dividers formed of fabric or flexible plate are connected between the corresponding corrugated longitudinal members of frames. With this, it is possible to orderly keep golf clubs in the golf bag.

It is another object of the present invention to provide a golf bag wherein the corrugated longitudinal members of both upper and lower frames may be formed in one of a variety of shapes for providing an aesthetically pleasing device.

The above and other objects, features and advantages of the present invention will become apparent from the following detailed description taken with the accompanying drawings.

BRIEF DESCRIPTION OF THE DRAWINGS

FIG. 1A is a perspective view of a conventional golf bag,

FIG. 1B is a top plan view of the FIG. 1A golf bag;

FIG. 2A is an exploded view of club dividers of another conventional golf bag;

FIG. 2B is a top plan view of the assembled FIG. 2A club dividers mounted in a frame;

FIG. 2C is a plan view of extended club dividers shown in FIG. 2A;

FIG. 3A is an exploded view of a first preferred embodiment of frames and club dividers of golf bag according to the invention;

FIG. 3B is a schematic cross-sectional view of the assembled FIG. 3A golf bag;

FIG. 3C is an enlarged fragmentary view of the bottom frame shown in FIG. 3B;

FIG. 4A is an exploded view of a second preferred embodiment of frames and club dividers of golf bag according to the invention;

FIG. 4B is a schematic cross-sectional view of the assembled FIG. 4A golf bag;

FIG. 5A is a perspective view of a golf bag incorporating the frames and club dividers according to the invention;

FIG. 5B is a partially cut-away perspective view of upper portion of the FIG. 5A golf bag; and FIG. 5C is a top plan view of the FIG. 3A or FIG. 4A frame; and FIG. 6 is a top plan view of another frame configuration according to the invention.

DETAILED DESCRIPTION OF THE PREFERRED EMBODIMENTS

Referring to FIGS. 3A to 3C, there is shown a first preferred embodiment of top annular frame 2, bottom annular frame 3, and club dividers 4 of golf bag 1 according to the invention. Top frame 2 has a plurality of equally spaced corrugated longitudinal members 21 formed therein. Similarly, bottom frame 3 has a plurality of equally spaced corrugated longitudinal members 31 formed therein. But the cross-section of corrugated longitudinal member 31 is a "U" (i.e., a groove 32 is formed). Further, a plurality of holes (two are shown) 33 are formed on the wall of corrugated longitudinal member 31. Club divider 4 is formed of fabric in this embodiment. Club divider 4 comprises an upper Velcro type fastener 41 and a mating Velcro type fastener 41' below the upper Velcro type fastener 41 by a predetermined distance. The Velcro type fasteners 41 and 41' are also known as hook and loop fasteners. Club divider 4 is coupled to a flexible plate member 42 in the bottom. A plurality of latched members (two are shown) 421 are formed on plate member 42. In assembly, enclose corrugated longitudinal member 21 of top frame 2 with the upper portion of club divider 4 by securing upper Velcro type fastener 41 to lower mating Velcro type fastener 41'. At this time, club divider 4 is bent. Then insert plate member 42 into the groove 32 of corrugated longitudinal member 31 of bottom frame 3 with latched members 421 clung to the holes 33. This completes a club divider device for golf bag.

Referring to FIGS. 4A and 4B, there is shown a second preferred embodiment of frames and club dividers of golf bag 1 according to the invention. The differences between first and second preferred embodiments are detailed below. In the second preferred embodiment, club dividers 4 are implemented as flexible plate members 5. Further, the cross-section of corrugated longitudinal member 21 is a "n" (i.e., a groove 22 is formed) and the cross-section of corrugated longitudinal member 31 is a "U" (i.e., a groove 32 is formed). In assembly, insert plate member 5 into the groove 22 of top frame 2 and the groove 32 of bottom frame 3 respectively. This also completes a club divider device for golf bag.

Referring to FIGS. 5A and 5B, it is seen that golf clubs 6 are orderly placed in the club divider after frames and club dividers have been assembled and stitched to golf bag 1.

Referring to FIG. 6, there is shown another frame configuration according to the invention. As shown from the top of golf bag, the corrugated longitudinal member 7 of either upper or lower frame may be shaped as a member having five round projections enclosed a circle. Further, a cross is formed in the circle. This can provide an aesthetically pleasing devices.

While the invention has been described by means of specific embodiments, numerous modifications and variations could be made thereto by those skilled in the art without departing from the scope and spirit of the invention set forth in the claims.

What is claimed is:

1. A golf bag comprising:

a top annular frame;

a plurality of spaced corrugated first longitudinal members in the top annular frame;

a bottom annular frame;

a plurality of spaced corrugated second longitudinal members in bottom annular frame, each of the second longitudinal members having a substantially U-shaped groove and a plurality of holes on the wall of the second longitudinal member;

a plurality of club dividers each formed of fabric, each of the club divider including an upper first fastener and a lower mating second fastener; and a plurality of flexible plate members each formed in the bottom of the club divider, each plate member having a plurality of latched members, wherein the first longitudinal members are enclosed by the club dividers by securing the upper first fastener to the lower mating second fastener and the plate members are inserted into the grooves of the second longitudinal members with the latched members clung to the holes.

2. The golf bag of claim 1, wherein the first and second fasteners are hook and loop fasteners.

* * * * *